US010272976B1

(12) United States Patent
Newhall et al.

(10) Patent No.: US 10,272,976 B1
(45) Date of Patent: Apr. 30, 2019

(54) FLOATING BAR APPARATUS

(71) Applicants: Don Newhall, Murfreesboro, TN (US); William M. Gwinn, Antioch, TN (US); Walter D. Achuff, Lavergne, TN (US)

(72) Inventors: Don Newhall, Murfreesboro, TN (US); William M. Gwinn, Antioch, TN (US); Walter D. Achuff, Lavergne, TN (US)

(73) Assignee: DBD Associates LLC, Nashville, TN (US)

( * ) Notice: Subject to any disclaimer, the term of this patent is extended or adjusted under 35 U.S.C. 154(b) by 110 days.

(21) Appl. No.: 15/073,107

(22) Filed: Mar. 17, 2016

(51) Int. Cl.

| | |
|---|---|
| ***B65D 88/78*** | (2006.01) |
| ***B63B 35/73*** | (2006.01) |
| ***A47G 23/02*** | (2006.01) |
| ***B65D 25/10*** | (2006.01) |
| *B65D 25/04* | (2006.01) |

(52) U.S. Cl.
CPC ..... *B63B 35/73* (2013.01); *A47G 23/0208* (2013.01); *A47G 23/0241* (2013.01); *B65D 25/108* (2013.01); *A47G 2200/02* (2013.01); *B63B 2035/737* (2013.01)

(58) Field of Classification Search
CPC ..... B65D 25/108; B63B 35/73; B63B 35/737; B63B 2035/737; A47G 23/0208; A47G 23/0241; A47G 2200/02
USPC ..... 220/560, 505, 507, 509
See application file for complete search history.

(56) References Cited

U.S. PATENT DOCUMENTS 4,638,593 A 1/1987 Garcia
D307,854 S * 5/1990 Doucette ..... D7/605
5,518,431 A * 5/1996 Staley ..... A47C 15/006 114/345
5,558,214 A * 9/1996 Brundidge ..... A45C 13/02 206/162
D375,781 S * 11/1996 Caldwell ..... D22/134
6,014,833 A * 1/2000 Benavidez ..... A01K 97/06 206/315.11
6,029,845 A * 2/2000 Mueller ..... A47G 23/02 220/560
6,085,926 A * 7/2000 Weiss ..... A45C 11/20 206/514
6,139,382 A * 10/2000 Eschbacher ..... B63B 22/24 114/357
6,491,179 B2 12/2002 Dokun
(Continued)

FOREIGN PATENT DOCUMENTS

WO 0041942 7/2000

*Primary Examiner* — J. Gregory Pickett
*Assistant Examiner* — Niki M Eloshway
(74) *Attorney, Agent, or Firm* — Waller Lansden Dortch & Davis, LLP; Blake M. Bernard

(57) ABSTRACT

A recreational floating bar apparatus capable of carrying beverages including liquor bottles and drinking vessels having a floatable base. A liquor bottle rack can extend upward from the floatable base, the liquor bottle rack having at least two compartments, each compartment sized to receive one of the liquor bottles. A plurality of drinking vessel retainers can be positioned on the floatable base about the liquor bottle rack. The plurality of drinking vessel retainers can include a first set of drinking vessel retainers having a first size, and a second set of drinking vessel retainers having a second size. The apparatus can be used to store relatively large amounts of beverages to help reduce the need for a user to exit the water to retrieve more beverages.

19 Claims, 8 Drawing Sheets

(56) References Cited

U.S. PATENT DOCUMENTS

| | | | | |
|---|---|---|---|---|
| 6,502,656 | B2 * | 1/2003 | Weiss | A45C 5/14 180/168 |
| 7,798,876 | B2 | 9/2010 | Mix | |
| 8,707,883 | B2 | 4/2014 | Peters | |
| D714,593 | S | 10/2014 | Light | |
| 2005/0279013 | A1 * | 12/2005 | Iwaniec | A01K 81/06 43/55 |
| 2009/0101655 | A1 * | 4/2009 | Tess | B63B 5/24 220/560 |
| 2010/0252560 | A1 * | 10/2010 | Churchill | A47G 23/02 220/560 |
| 2011/0204756 | A1 * | 8/2011 | DeMars | A47F 9/00 312/140.2 |
| 2013/0119850 | A1 * | 5/2013 | Breyburg | A47B 71/00 312/408 |
| 2016/0061512 | A1 * | 3/2016 | Sutton, III | H04R 1/028 361/807 |
| 2017/0112303 | A1 * | 4/2017 | Miller | A47G 19/02 |

* cited by examiner

FLOATING BAR APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to floatation apparatuses. Such devices are used in and around swimming pools, as well as on open water such as lakes, rivers, bays, oceans, beaches etc.

More particularly, the present disclosure relates to a floatation apparatus for holding different types of beverages, including alcoholic and nonalcoholic beverages. One particular situation where such apparatuses are used is on recreational lake trips where a user can anchor his boat in the lake, and swim or float in the water near the anchored vessel. In many situations large groups of people will take such trips together, and such groups can socialize with one another in the water. A user will typically store beverages on the boat or transportation vessel. Every time the user desires another drink, the user is forced to get out of the water and back onto the boat in order to retrieve another drink. In another situation, a user swimming or relaxing in a pool would keep drinks in a cooler or other storage bin outside of the pool, the user having to exit the pool each time the user desires to get another drink. Having to exit the water to retrieve another drink can be cumbersome and generally undesirable.

Some conventional floating apparatuses include one or more cup holders such that as a user floats in the water they can place or store a drink in the cup holder. However, such devices only allow the user to carry one or two drinks at a time. The user still has to exit the water each time the user needs another drink. In other conventional devices, floats can include a large space for storing beverages. However, drinks are stored loosely and in a disorganized fashion in such large containers. Further, such storage bins are primarily used for canned beverages such as beer and soft drinks, but are not conducive for the storage of liquor bottles and mixers for various liquor drinks. Such bottles are typically glass and can break when placed loosely in larger containers with other items.

What is needed then are improvements in floating apparatuses for carrying beverages.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a recreational floating bar apparatus capable of carrying beverages including liquor bottles and drinking vessels. The apparatus can include a floatable base, and a liquor bottle rack extending upward from the floatable base. The liquor bottle rack can have at least two compartments, each compartment sized to receive and retain one of the liquor bottles. A plurality of drinking vessel retainers can be positioned on the floatable base about the liquor bottle rack. As such, liquor bottles or other large beverage containers can be safely stored in the liquor bottle rack, and drinking vessels such as cups, drinking glasses, cans, or shot glasses can be retained in the drinking vessel retainers while the user floats or swims in the water around the floating bar apparatus. Such an apparatus can help reduce the amount of times the user has to exit the water to get more beverages.

In some embodiments, the liquor bottle rack can include a row of compartments such that different types of liquor bottles can be organized in and be readily accessible from the liquor bottle rack. In some embodiments, the floating bar apparatus can include a first set of drinking vessel retainers and a second set of drinking vessel retainers. The first set of drinking vessel retainers can be positioned about or radially outward from the liquor bottle rack, and the second set of drinking vessels can be positioned about or radially outward from the liquor bottle rack and the first set of drinking vessel retainers. In some embodiments, each of the first set of drinking vessel retainers can have a first diameter, and each of the second set of drinking vessel retainers can include a second diameter, and the second diameter can be larger than the first diameter. As such, in some embodiments, the first set of drinking vessel retainers can be sized to adequately retain and smaller vessels such as shot glasses, and the second set of drinking vessels can be sized to retain and hold larger vessels such as cups or cans.

One objective of the present disclosure is to provide a floating bar apparatus that can hold a relatively large amount of beverages at one time to help reduce the need of the user to exit the water to retrieve more drinks.

Another objective of the present disclosure is to provide beverage storage features that allow efficient access to the beverages stored on the apparatus.

Another objective of the present disclosure is to provide a floating bar apparatus that is capable of safely and efficiently storing and organizing various types of beverages.

Another objective of the present disclosure is to provide an apparatus around which large groups of people can congregate and socialize.

Numerous other objects, advantages and features of the present disclosure will be readily apparent to those of skill in the art upon a review of the following drawings and description of a preferred embodiment.

DETAILED DESCRIPTION

Figure 1:
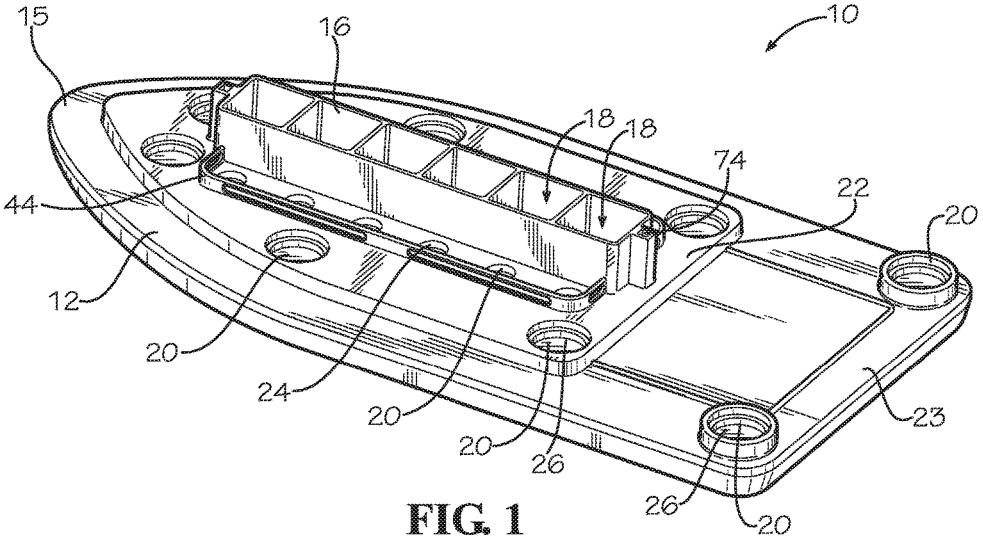
FIG. 1 is a perspective view of an embodiment of a floating bar apparatus of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

An embodiment of a floating bar apparatus 10 is shown in FIG. 1. Apparatus 10 can be capable of carrying beverages including liquor bottles and drinking vessels such as cups, glasses, cans, bottles, shot glasses, etc. Apparatus 10 can include a floatable base 12. A liquor bottle rack 16 can extend upward from floatable base 12. Liquor bottle rack 16 can include at least two compartments 18. Each compartment 18 can be sized to receive and/or retain a liquor bottle. In other words, each compartment is large enough to hold a liquor bottle. A liquor bottle can be defined as a standard 750 ml bottle, or "fifth", of liquor. In other embodiments, compartments 18 can be sized or be larger enough to hold a standard 1.75 liter, or "handle", of liquor. A plurality of drinking vessel retainers 20 can be positioned on floatable base 12 about liquor bottle rack 16.

In some embodiments, floatable base 12 can be a hollow structure having an outer layer of water resistant material, for instance, vinyl or polyvinyl chloride (PVC), the outer layer selectively retaining a volume of air to give floatable base its buoyant characteristics via an air valve. As can be seen from FIG. 3, In some embodiments, floatable base 12 can include one or more internal support ribs 14 which provide structure to the floatable base 12. The support ribs 14 can extend both in a lateral and longitudinal direction along floatable base 12 in some embodiments.

In other embodiments, floatable base 12 can be made from any suitable low density material with high buoyancy which can float and support a significant amount of weight on water without sinking, including but not limited to, Ethylene vinyl acetate foam, high density polyethylene, polystyrene, urethane foam, low density metals, aluminum, lightweight steel, closed cell foams, etc.

Floatable base 12 can be tailored to form a variety of aesthetic shapes. For instance, in some embodiments, floatable base 12 can have a pointed forward end 15 and a generally rectangular rear end 17. As such, floatable base 12 can generally form the shape of a traditional boat to provide a certain aesthetic appearance.

Figure 3:
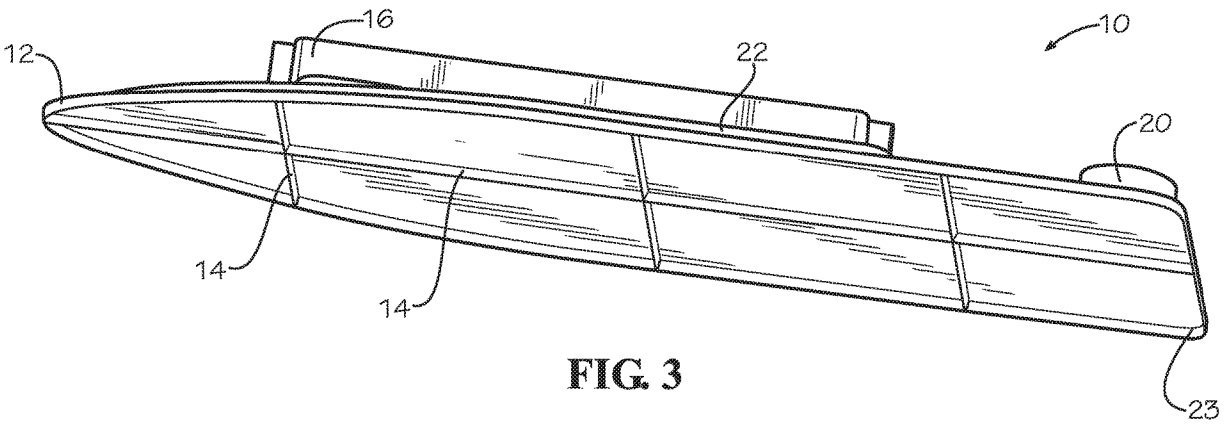
FIG. 3 is a bottom perspective cross sectional view of the apparatus of FIG. 1 showing internal support ribs within a floatable base.
Figure 4:
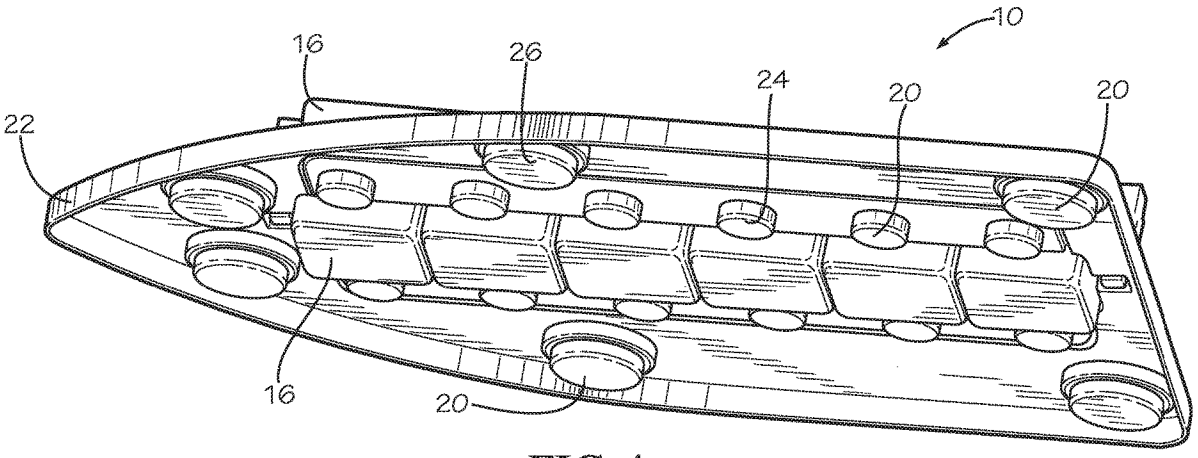
FIG. 4 is another bottom perspective cross sectional view of the apparatus of FIG. 1 showing a liquor bottle rack and various drinking vessel retainers being recessed into an upper extension member of the floatable base.

As can be seen in FIGS. 1, 3, and 4, floatable base 12 in some embodiments can include an upper member 22 and a lower member 23. In such embodiments, one or more of the liquor bottle rack 16 and drinking vessel retainers 20 can be defined on upper member 22. In some embodiments, at least some of drinking vessel retainers 20 can be recessed into upper member 22. In other embodiments, at least some drinking vessel retainers can extend upward from upper member 22. Internal support ribs 14 can be positioned within lower member 23. In some embodiments, one or more drinking vessel retainers 20 can be positioned on lower member 23, and can be either recessed into lower member 23, or extend upward from lower member 23.

Figure 2:
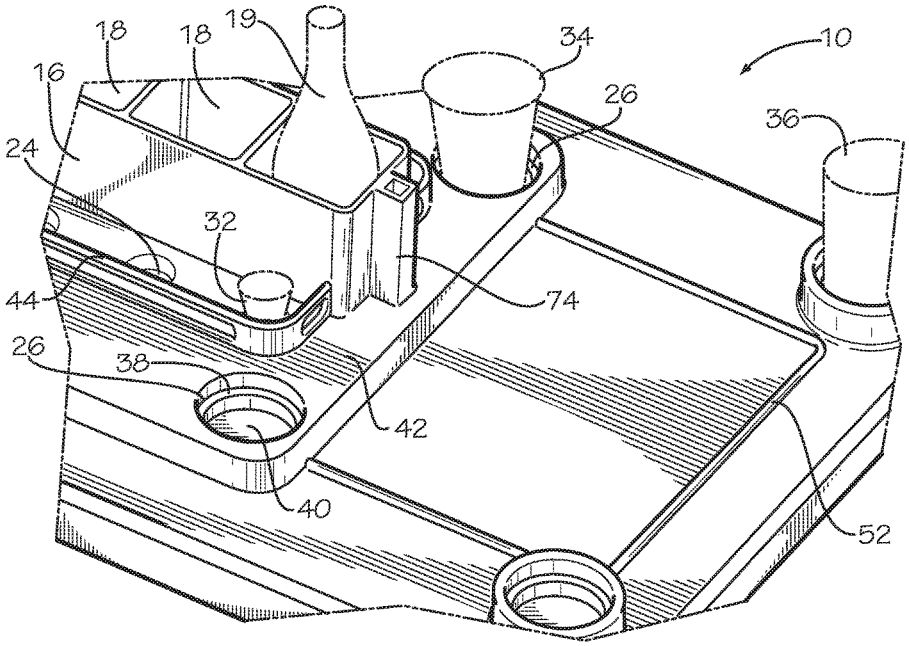
FIG. 2 is a perspective detailed view of the apparatus of FIG. 1.

In some embodiments, as shown in FIGS. 1 and 2, liquor bottle rack 16 can include at least two compartments 18. In other embodiments, liquor bottle rack 16 can include a row of compartments 18. Each compartment 18 can be sized to receive a liquor bottle 19 such that multiple liquor bottles can be stored and organized in liquor bottle rack 16 on floatable base 12. In FIG. 1, liquor bottle rack 16 is shown having 6 compartments. In still other embodiments, liquor bottle rack 16 can include three, four, five, seven, eight, etc. compartments for holding various amounts of liquor bottles.

While liquor bottle rack 16 is sized to receive and capable of holding conventional 750 milliliter liquor bottles, and in some embodiments conventional 1.75 liter liquor bottles, the compartments 18 in liquor bottle rack 16 can also be sized and used to receive and store other large liquid containers, such as two and three liter soda bottles and other mixer bottles that can come in containers large enough to hold more than a single serving of liquid. As such, liquor bottle rack 16 can be utilized to carry and store a large variety of liquid containers, not just liquor bottles. In some embodiments, each compartment 18 of liquor bottle rack 16 can have a rectangular cross section. A rectangular cross section can allow liquor bottles and other drinking containers of varying shapes, including round, square, rectangular, and oblong liquor bottles and drinking containers to be stored in compartments 18 of liquor bottle rack 16. In some embodiments, each compartment can have a length, width, and height that are larger than four inches. In some embodiments, the length, width, and height of each compartment can be larger than 6 inches.

Figure 5:
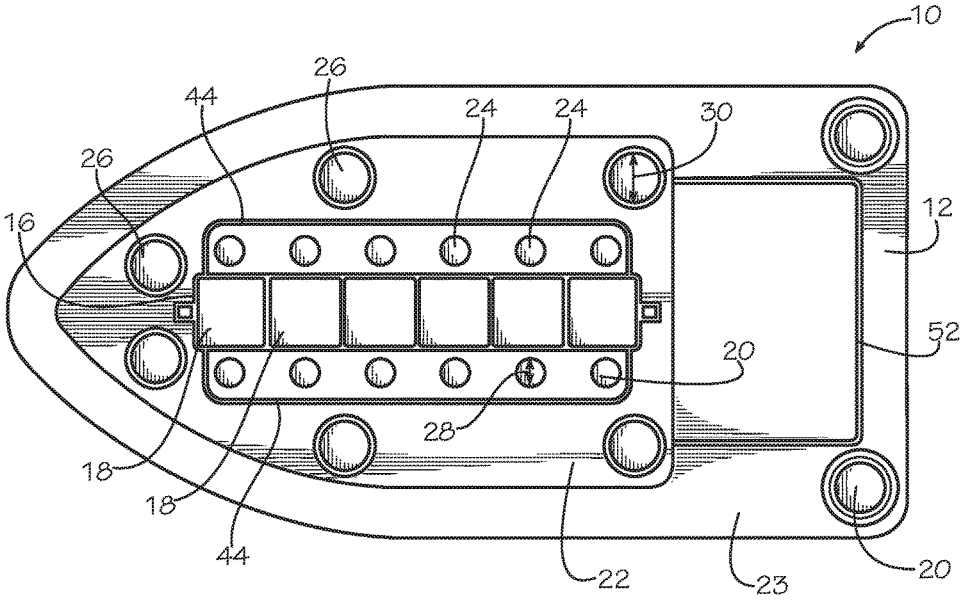
FIG. 5 is a top view of the apparatus of FIG. 1.

In some embodiments, as shown in FIG. 5, plurality of drinking vessel retainers 20 can include a first set of drinking vessel retainers 24 and a second set of drinking vessel retainers 26. In some embodiments, first set of drinking vessel retainers 24 can be positioned on floatable base 12 about liquor bottle rack 16, and second set of drinking vessel retainers 26 can be positioned about liquor bottle rack 16 and first set of drinking vessel retainers 24. In some embodiments, the position of first set of drinking vessel retainers 24 can be described as being positioned perimetrically around liquor bottle rack 16 on floatable base 12, and second set of drinking vessel retainers 26 can be described as being positioned perimetrically around liquor bottle rack 16 and first set of drinking vessel retainers 24. In still other embodiments, first set of drinking vessels 24 can be described as being positioned radially outward from liquor bottle rack 16 on floatable base 16, and second set of drinking vessel retainers 26 can be positioned radially outward from both liquor bottle rack 16 and first set of drinking vessel retainers 24 on floatable base 12. A first element being positioned radially outward on floatable base 12 from a second element means that the second element is positioned closer to a center of floatable base 12 than the second element.

In FIG. 5 it can be seen that in some embodiments first plurality of drinking vessel retainers 24 can generally surround or form a ring or circle around liquor bottle rack 16, and second set of drinking vessel retainers 26 can generally surround or form a ring or circle around liquor bottle rack 16 and first set of drinking vessel retainers 24. Second set of drinking vessel retainers 26 being positioned radially outward from first set of drinking vessel retainers 24 in such an embodiment can mean that the ring of first set of drinking vessel retainers 24 can be positioned within the ring of second set of drinking vessel retainers 26.

In some embodiments, each of the first set of drinking vessel retainers 24 can have a first diameter 28, and each of the second set of drinking vessel retainers 26 can have a second diameter 30. The second diameter 30 can be larger than the first diameter 28. As such, first set of drinking vessel retainers 24 can hold drinking vessels of a first size and the second set of drinking vessel retainers 26 can hold drinking vessels of a second size. As can be seen in FIG. 2, in some embodiments, first set of drinking vessel retainers 24 can be sized to adequately hold a shot glass 32, or other smaller vessel, in each drinking vessel retainer, and second set of drinking vessel retainers 26 can be sized to hold a larger drinking vessel, such as a cup 34, can 36, or 12 ounce bottle, in each drinking vessel retainer. As such, apparatus 10 can include adequate drinking vessel retainers 20 for a large variety of drinking vessels and drink selections by the user.

In some embodiments, as shown in FIGS. 1 and 2, apparatus 10 can include one or more guard rails 44 at least partially surrounding first set of drinking vessel retainers 24. Guard rails 44 can extend upward from floatable base 12 in some embodiments. In other embodiments, guard rails 44 can extend from liquor bottle rack 16. In some embodiments, first set of drinking vessel retainers 24 can include a first row of drinking vessel retainers positioned adjacent a first lateral side of liquor bottle rack 16 on floatable base 12, and a second row of drinking vessel retainers positioned adjacent a second lateral side of liquor bottle rack 16. In such an embodiment, a separate guard rail 44 can at least partially surround each row of drinking vessel retainers of first set of drinking vessel retainers 24, such that each row is positioned between a corresponding guard rail 44 and liquor bottle rack 16. In other embodiments, a single guard rail can surround both the first and second rows of drinking vessel retainers in first set of drinking vessel retainers 24. Shot glasses 32 or other small drinking vessels that may become dislodged or fall out of first set of drinking vessel retainers 24 can be contained between guard rails 44 and liquor bottle rack 16 when apparatus 10 is in use on the water. As such, guard rails 44 can help prevent smaller drinking vessels from falling off of apparatus 10 and into the water, helping decrease waste of drinking vessels and pollution of the water in which apparatus 10 is floating.

Conventional drinks can come in bottle or cans of various sizes. For instance, some cans and bottles can be shorter and wider, while others are taller and skinnier. In some embodiments, second set of drinking vessels 26 can include an intermediate shelf 38. Each intermediate shelf 38 can extend upward from a bottom floor 40 of a corresponding drinking vessel retainer of second set of drinking vessel retainers 26, but stop before reaching the local upper surface 42 of floatable base 12. As such, a user can either rest the desired drinking vessel on the floor 40 of drinking vessel retainer 26 or on intermediate shelf 38 of drinking vessel retainer 26, allowing drinking vessel retainer 26 to adequately accommodate drinking vessels of various shapes and sizes.

Figure 6:
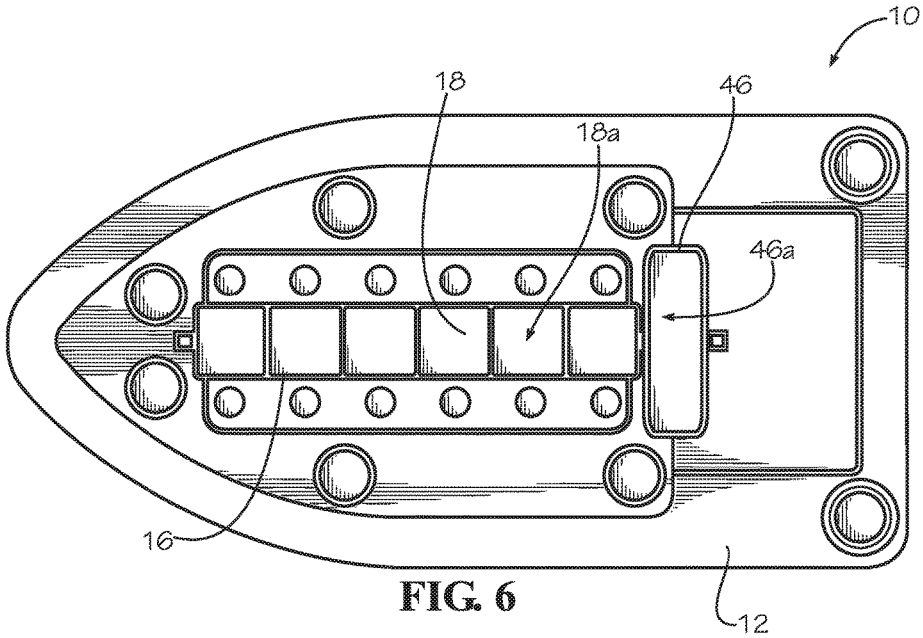
FIG. 6 is a top view of a floating bar apparatus including a storage container.

Referring now to FIG. 6, in some embodiments, apparatus 10 can include a storage container 46 positioned beside the liquor bottle rack 16 on floatable base 12. In some embodiments, compartments 18 can each have a compartment volume 18*a* and storage container 46 can have a container volume 46*a*. Container volume 46*a* can be greater than compartment volume 18*a*. As such, storage container 46 can include a larger storage volume 46*a* which can be used to store ice to make drinks, or alternatively to store trash such as empty cans or bottles so that the empty cans and bottles can be contained on apparatus 10 and not fall into and pollute the water. Storage container 46 is shown in FIG. 6 as being positioned rearward of liquor bottle rack 16. In other embodiments, storage container 46 can be positioned forward of or on one of the lateral sides of liquor bottle rack 16.

Figure 7:
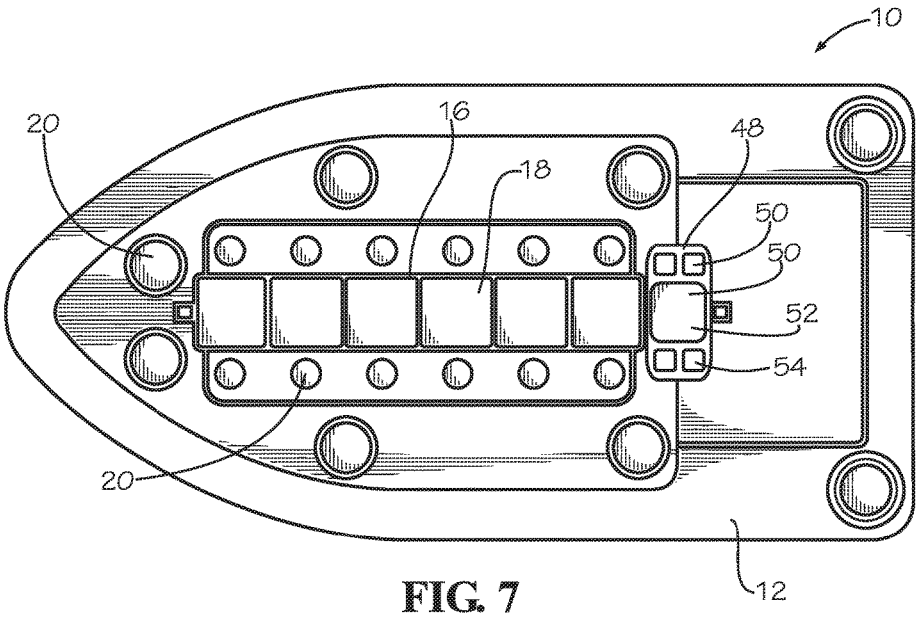
FIG. 7 is a top view of a floating bar apparatus including an accessory holder including a plurality of accessory compartments.

In some embodiments, as shown in FIG. 7, apparatus 10 can include an accessory holder 48 positioned beside liquor bottle rack 16. Accessory holder 48 can be positioned on floatable base 12 in some embodiments. Accessory holder 48 can include a plurality of accessory compartments 50. In some embodiments, accessory compartments 50 can have a variety of shapes and sizes, including some larger accessory compartments 52 and some smaller accessory compartments 54. The accessory compartments 50 can be used to hold and store a variety of different objects that may be useful in making cocktails or other drinks on the water, including but not limited to, napkins, straws, stirrers, drink umbrellas, toothpicks, fruit, garnishes, etc. Accessory holder 48 in FIG. 7 is shown positioned rearward of liquor bottle rack 16. In other embodiments, accessory holder 48 may be positioned forward of liquor bottle rack, or on either lateral side of liquor bottle rack 16.

Some embodiments of apparatus 10 may include either the storage container 46 of FIG. 6, or the accessory holder 48 of FIG. 7. In other embodiments, apparatus 10 may include both storage container 46 and accessory holder 48. Storage container 46 for instance could be positioned rearward of liquor bottle rack 16 on floatable base 12 and accessory holder 48 could be positioned forward of liquor bottle rack 16 on floatable base 12. As such, users of apparatus 10 can have a place to store the various accessories mentioned above, and also have a space to store ice for cocktails, or trash as drinks are consumed.

Figure 8:
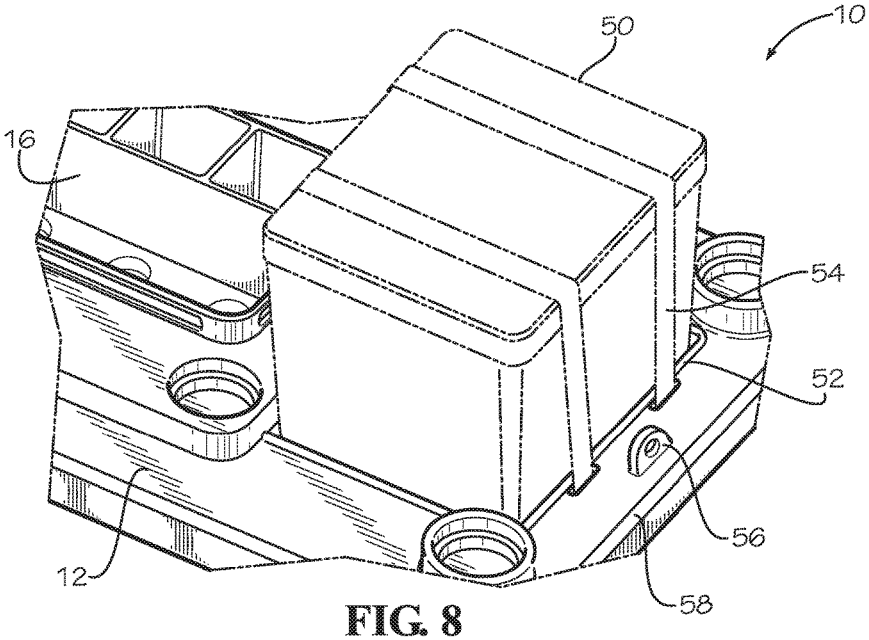
FIG. 8 is a perspective detailed view of a floating bar apparatus including cooler straps and a secondary float hitch.

In some embodiments, floatable base 12 can include a space rearward of liquor bottle rack 16 where a conventional cooler or ice chest 50 can be stored, as shown in FIG. 8. Cooler 50 can hold cold drinks such as beer or soft drinks, as well as ice to keep the drinks cold. As such, apparatus 10 can be used in some embodiments to hold both liquor bottles in liquor bottle rack 16 and cold drinks in cooler 50.

In some embodiments, apparatus 10 can include a cooler retention rim 52 extending upward from floatable base 12. Cooler retention rim 52 can extend upward from floatable base 12 adjacent liquor bottle rack 16. A cooler 50 can be placed within cooler retention rim 52 such that cooler 50 can be retained and remain in position on floatable base 12 by cooler retention rim 52. Cooler retention rim 52 can thereby help prevent cooler 50 from falling into the water as apparatus 10 floats on the water, the water at times becoming turbulent due to waves or the wake of passing boats or water vessels.

In some embodiments, apparatus 10 may also include cooler straps 54 connected to floatable base 12. Cooler straps 54 can be used to secure cooler 50 to floatable base 12 when cooler 50 is not being accessed. Cooler straps 54 can include a quick disconnect feature, including but not limited to, snaps, hook and loop assemblies, buckles, clips, hooks, etc., such that cooler straps 54 can be quickly disconnected when a user desires to gain access to the contents of cooler 50, and quickly reconnected once the user closes cooler 50.

In some embodiments, apparatus 10 can include a secondary float hitch 56 disposed on floatable base 12. In some embodiments, secondary float hitch 56 can be positioned on a rear edge 58 of floatable base 12. A second floatable apparatus can be tied to secondary float hitch 56 such that the secondary float can be connected to apparatus 10. The secondary float can be a typical float that a user could lay on in the water, or the secondary float could be a float for carrying additional drinks, for instance in a second cooler.

Apparatus 10 thus has been described as being capable of holding a wide variety and relatively large amounts of beverages, including but not limited to liquor bottles in liquor bottle rack 16, as well as canned or 12 ounce bottled beverages in a cooler positioned on floatable base 12 or in a secondary float towed behind apparatus 10. Typically, a user when floating or swimming in the water would only carry a single drink with them. The user would then need to constantly get in and out of a boat on a lake or other body of water, or get in and out of a pool, in order to retrieve another drink. Similarly, conventional float devices have offered very limited storage space for beverages on the floats, most simply offering one or two cup holders on the floats. Such float devices are also geared towards a single user, as opposed to a large group socializing together in the water. Apparatus 10 can be used to help store a relatively larger amount of beverages in the water, including liquor, beer, water, soft drinks, etc., and help reduce the amount of times users are required to exit the water to retrieve more beverages. Apparatus 10 can be particularly useful to supply beverages to large groups socializing in the water.

Apparatus 10 can also be used as a floating bar station, where groups of users can personally float on their own individual floats or rafts in the water, and swim or float up to apparatus 10 when the users desire to retrieve a beverage or make another drink. Users could also congregate around floating bar apparatus 10 such that apparatus 10 can be a center of social activity in the water. In some embodiments, floating bar apparatus 10 could also include a plurality of float extensions extending radially outward from floatable base 12, each floating extension providing a location for a user to sit and float in the water, such that floating apparatus 10 can operate similar to an actual bar, with user's sitting around apparatus 10 and socializing.

Figure 9:
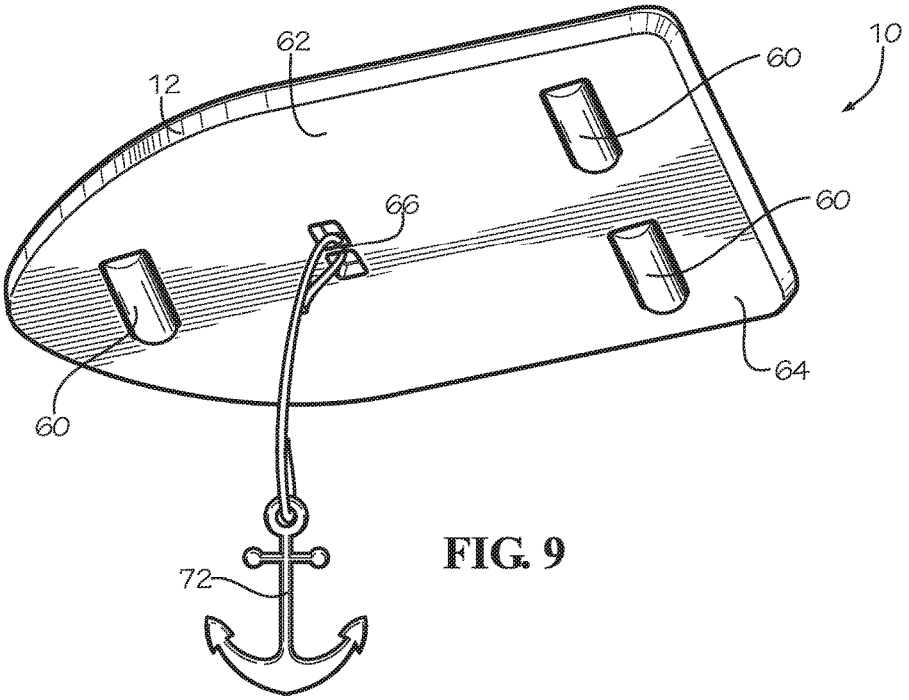
FIG. 9 is a bottom perspective view of a floating bar apparatus including a plurality of rollers and an anchor hitch.

In some embodiments, as shown in FIG. 9, apparatus 10 can include a plurality of wheels 60 on floatable base 12. Wheels 60 can be rotationally disposed on floatable base 12, such the wheels 60 can rotate relative to floatable base 12. Wheels 60 can also extend downward from floatable base 12, such that wheels 60 extend from a side of floatable base 12 that is generally opposite the liquor bottle rack. Wheels 60 can make transportation of apparatus 10 easier, especially when apparatus 10 is loaded down, as apparatus 10 can be rolled along wheels 60. For instance, apparatus 10 can be loaded down with beverages on a dock and then the apparatus 10 can be rolled onto a boat for travel and then rolled into the water once the boat is anchored in the water. Similarly, apparatus 10 could be loaded with beverages poolside and then apparatus 10 could be rolled straight into the pool.

In some embodiments, wheels 60 extend entirely below floatable base 12 such that a relatively large clearance between floatable base 12 and the ground is formed. Apparatus 10 can include one or more brackets attached to floatable base 12 and each wheel 60 can be mounted to a corresponding bracket. In other embodiments, wheels may be partially inset into floatable base 12 such that only a portion of each wheel extends below floatable base 12. While such a configuration may tend to reduce the clearance between floatable base 12 and the ground, such a wheel 60 configuration may help make apparatus 10 more compact, particularly for storage purposes. In some embodiments, as shown in FIG. 9, wheels 60 may be spread out over a bottom surface 62 of floatable base 12. In other embodiments, wheels 60 may be located on only one side or half of the bottom surface 62 of floatable base 12, for instance a rear half 64 of bottom surface 62. A front side of floatable base 12 could then be equipped with a handle or rope such that a user could lift the front end of floatable base 12, and apparatus 10 could be rolled on the wheels 60 on the rear side 64 of floatable base 12.

Figure 10:
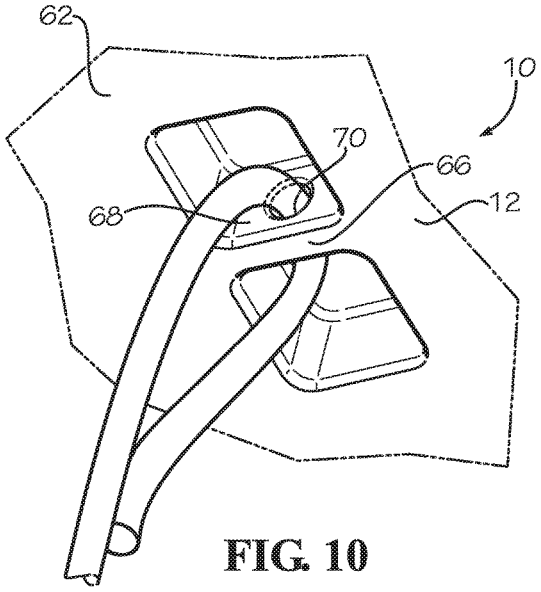
FIG. 10 is a detailed perspective view of the anchor hitch of FIG. 9.

In some embodiments, as shown in FIGS. 9 and 10, apparatus 10 can include an anchor hitch 66 disposed on floatable base 12. In some embodiments, anchor hitch 66 can be recessed into floatable base 12 such that anchor hitch 66 doesn't protrude from floatable base 12 and interfere with the ground as apparatus 10 is transported or rolled across the ground. In those embodiments without wheels, having anchor hitch 66 recessed into floatable base 12 and can help bottom surface 62 of floatable base 12 rest flatly on the ground when apparatus 10 is being stored. In some embodiments, anchor hitch 66 can include a hitch plate 68 having a hole 70 defined therein. An anchor 72 can be tied to anchor hitch 66 through hole 70 in hitch plate 68. Having an anchor 72 tied to floatable base 12 can allow apparatus 10 to be anchored in the water, and particularly on an open body of water, such that apparatus 10 can be retained in a generally stationary position within the water and not float away.

Referring again to FIG. 1, in some embodiments, liquor bottle rack 16 can include one or more extension ports 74. A variety of auxiliary components can be inserted into extension ports 74 as desired by the user. In some embodiments, the auxiliary components can be detachably disposed on liquor bottle rack 16 by removably inserting the auxiliary components into extension ports 74.

Figure 11:
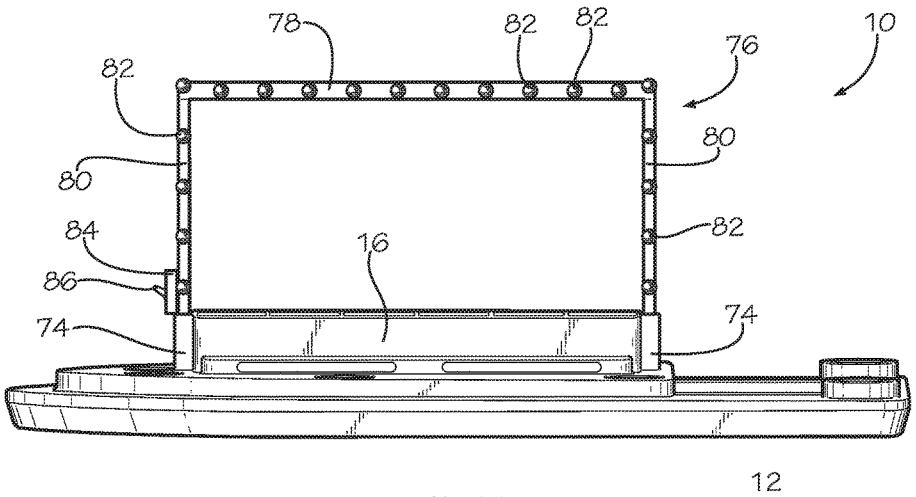
FIG. 11 is a side view of a floating bar apparatus including a lighting structure detachably disposed on a liquor bottle rack.

For instance, in some embodiments, apparatus 10 can include a lighting structure 76 as an auxiliary component, as shown in FIG. 11. Lighting structure 76 can include a top cross bar 78 and two vertical support bars 80 in some configurations, vertical support bars 80 supporting top cross bar 78. Each support bar 80 can be inserted into an extension port 74 on liquor bottle rack 16. Lighting structure 76 can include a plurality of light sources 82 on or in lighting structure 76. Light sources 82 can be positioned on or in both top cross bar 78 and support bars 80 in some embodiments. In other embodiments, light sources 82 can be positioned only in top cross bar 78. Light sources 82 can be any suitable lighting source, including fluorescent lamps, incandescent bulbs, halogen lamps, light emitting diodes (LEDs), torches, etc. Lighting structure 76 can be detachably disposed on liquor bottle rack 16 to produce light around apparatus 10 at night or in the dark on the water so that users can see each other and the contents of apparatus 10 on the water.

Light structure 76 can also add varying social aesthetics to apparatus 10 at night. In some embodiments, light sources 82 on lighting structure 76 can be sold in a variety of colors such that a user can tailor lighting structure 76 to their preference, for instance to match the color of lighting structure 76 with the colors of the user's boat. In other embodiments, light sources 82 on lighting structure 76 can be selectively alternated between various colors so the user can change the color of light sources 82 as desired.

In some embodiments, light structure 76 can include a power source 84 and a switch 86. Switch 86 can be configured to selectively supply power from power source 84 to light sources 82. Power source 84 can be any suitable power source, including one or more conventional and/or rechargeable batteries. In some embodiments, power source 84, light sources 82, and switch 86, as well as other electrical components can be encased in a waterproof material to help reduce the risk of the electrical components coming into contact with water while apparatus 10 is in use and shorting or becoming damaged.

Figure 12:
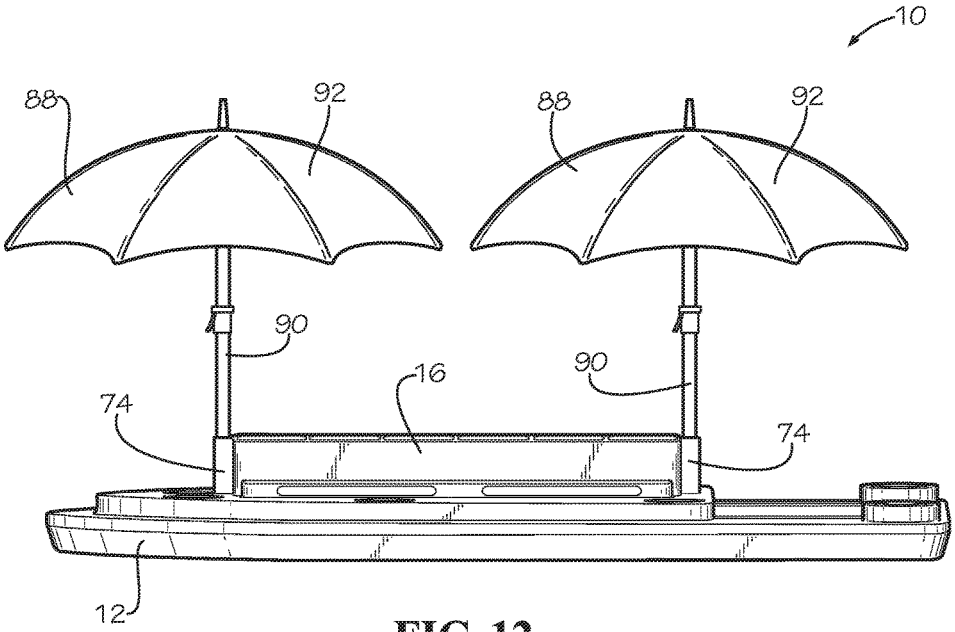
FIG. 12 is a side view of a floating bar apparatus including at least one shading structure detachably disposed on a liquor bottle rack.

In some embodiments, as shown in FIG. 12, apparatus 10 can include one or more shading structures 88 detachably disposed on liquor bottle rack 16, shading structures 88 extending upward from liquor bottle rack 16. In some embodiments, shading structures 88 can include umbrellas, each umbrella 88 having a pole 90 and an expandable canopy 92. Poles 90 of umbrellas 88 can be removably inserted or detachably disposed into a corresponding extension port 74 on liquor bottle rack 76 such that umbrellas 88 can be quickly disposed on and subsequently removed from liquor bottle rack 16 and apparatus 10. When canopies 92 are expanded, umbrellas 88 can provide shade over apparatus 10 which can help keep beverages on apparatus 10 in the shade and thus cooler, and also help keep users and swimmers floating near apparatus 10 in the shade. In some embodiments, apparatus 10 can include two umbrellas, one umbrella 88 detachably disposed on each end of liquor bottle rack 16. Canopies 92 can have a wingspan such that when canopies 92 are expanded the canopies have a tangential relationship or tangentially touch one another, providing relatively continuous shade across apparatus 10. In still other embodiments, apparatus 10 could include a singular shading structure having two or more supports that can extend into corresponding extension ports 74 on liquor bottle rack 16.

In FIGS. 1, 11, and 12, extension ports 74 are shown disposed on liquor bottle rack 16. In other embodiments, extension ports 74 can be disposed on any suitable surface of apparatus 10, including on floatable base 12, such that auxiliary components such as lighting structure 76 and umbrellas 88 can be detachably disposed on various components of apparatus 10.

In some embodiments, apparatus 10 can be motorized, and can include a small motor with a propeller mounted to floatable base 12. The motor can be controlled via wireless telemetry or with RFID technology from a remote such that a user can control motion of apparatus 10 without having to physically or manually move apparatus 10.

Figure 13:
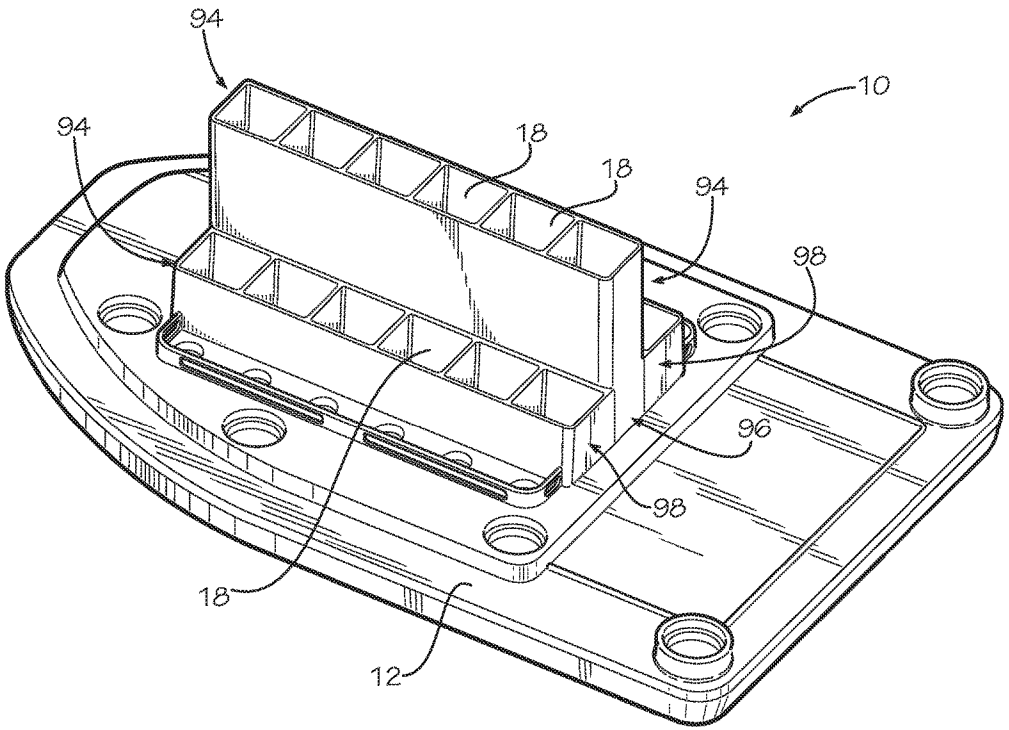
FIG. 13 is a detailed perspective view of a floating bar apparatus having a liquor bottle rack including multiple rows of compartments.

In some embodiments, as shown in FIG. 13, liquor bottle rack 16 can include multiple rows 94 of compartments 18, each being sized to receive a liquor bottle. Such a configuration allows a large number and variety of liquor bottles to be stored on liquor bottle rack 16. Liquor bottle rack 16 is shown in FIG. 13 having three rows of compartments totaling 18 compartments. In other embodiments, liquor bottle rack 16 could have five or more rows of compartments totaling 30 or more compartments. Such a configuration can be beneficial for commercial industries where apparatus 10 can be used, for instance in hotels. Apparatus 10 can be used by a hotel as a floating bar where servers can be positioned in the pool and serve customers and patrons drinks from apparatus 10 without the patrons having to exit the pool. Having multiple rows of compartments 18 in liquor bottle rack 16 can help a hotel provide a large variety of liquors in the pool via apparatus 10.

While many hotels have built in pool bars, apparatus 10 can offer a cost effective alternative to the expense of renovating a hotel pool to include a swim up bar. Apparatus 10 can also offer versatility that a built in bar does not, as a server can float and swim around the pool with apparatus 10 to serve drinks, as opposed to guests having to congregate at and crowd around a single location within the pool. In some embodiments, liquor bottle rack 16 can have an inner row of compartments 96, and two outer rows of compartments 98. Inner row of compartments 96 can extend above outer rows of compartments 98 from floatable base 12, such that multiple tiers or levels of compartments can be formed in liquor bottle rack 16. As such, servers can prioritize the liquor organized in liquor bottle rack 16, for instance by placing higher profile liquors on higher tiers or levels of liquor bottle rack 16.

Additionally, in the hotel environment, wheels 60 shown in FIG. 6 can be beneficial as apparatus 10 would likely be stocked or filled at a main bar outside of the pool with a large amount of beverages. Once apparatus 10 is full apparatus can be rolled on wheels 60 directly into a nearby pool. As such, apparatus 10 can be beneficial in both a recreational and commercial environment.

Figure 14:
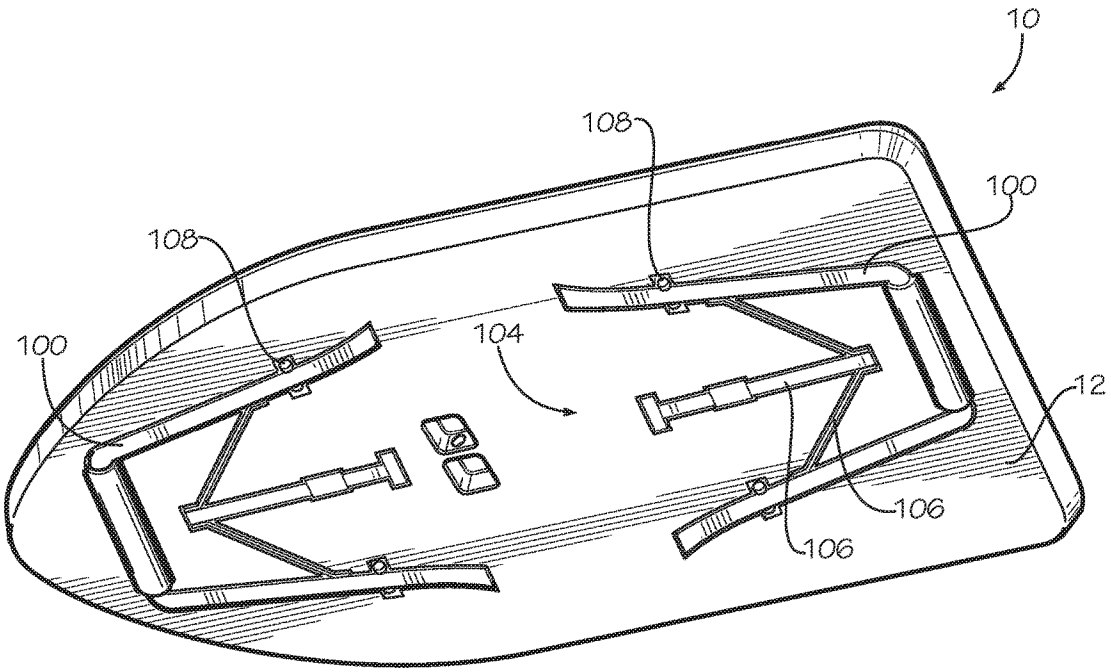
FIG. 14 is a bottom perspective view of a floating bar apparatus having expandable legs on a bottom surface of a floatable base.

In some embodiments, as shown in FIG. 14, apparatus 10 can include extendable legs 100 connected to floatable base 12. Extendable legs 100 can be movable between a retracted position as shown in FIG. 14, and an extended position where extendable legs 100 extend downward from floatable base 12. The legs 100 in the extended position can rest on the ground and support apparatus 10, similar to a standard table. As such, apparatus 10 can be used to serve drinks both in the water and out of the water, for instance poolside.

In FIG. 14, extendable legs 100 are shown as two pairs of extendable legs, each pair being pivotally connected to floatable base 12 at pivot point 102. Each pair of legs can also have a leg support bar system 104 including a plurality of leg support bars 106 that can expand to a generally linear orientation as the legs 100 move to the extended position, leg support bars 106 in leg support bar system 104 folding with respect to one another as the legs 100 move to the retracted position. Leg support bar system 104 can also include one or more retention clips 108 positioned on floatable base 12 to receive legs 100 as legs 100 move to a retracted position. Retention clips can also retain legs 100 in the retracted position. In still other embodiments, extendable legs 100 can be any suitable expandable and foldable leg structure, including but not limited to scissor legs and other sliding leg structures.

Thus, although there have been described particular embodiments of the present invention of a new and useful FLOATING BAR APPARATUS, it is not intended that such references be construed as limitations upon the scope of this invention.

What is claimed is:

1. A recreational floating bar apparatus capable of carrying beverages including 750 milliliter liquor bottles and drinking vessels, comprising:

a floatable base;

a liquor bottle rack located centrally on and extending upward from the floatable base, the liquor bottle rack including elongated opposing sidewalls extending upward from the floatable base and a row of at least 4 compartments defined between the elongated opposing sidewalls, the row of at least 4 compartments extending in the same direction as the elongated opposing sidewalls, each compartment having an upward oriented opening sized to receive one of the 750 milliliter liquor bottles;

a first set of drinking vessel retainers positioned radially outward from the liquor bottle rack on the floatable base, the first set of drinking vessel retainers at least partially surrounding the elongated opposing sidewalls of the liquor bottle rack, each drinking vessel retainer of the first set of drinking vessels having a first diameter;

a second set of drinking vessel retainers positioned radially outward from the liquor bottle rack and the first set of drinking vessel retainers on the floatable base, the second set of drinking vessel retainers at least partially surrounding the elongated opposing sidewalls of the liquor bottle rack and the first set of drinking vessel retainers, each drinking vessel retainer of the second set of drinking vessels having a second diameter, wherein the ratio of the first diameter to the second diameter is less than or equal to 0.7; and one or more guard rails at least partially surrounding the first set of drinking vessel retainers and positioned between the first set of drinking vessel retainers and the second set of drinking vessel retainers, the one or more guard rails extending above a local surface of the floatable base proximate the first set of drinking vessel retainers.

2. The apparatus of claim 1, wherein:

the row of compartments in the liquor bottle rack occupies the entire liquor bottle rack.

3. The apparatus of claim 1, further comprising a plurality of wheels rotationally disposed on the floatable base, the plurality of wheels extending downward from the floatable base.

4. The apparatus of claim 1, further comprising an anchor hitch disposed on the floatable base.

5. The apparatus of claim 4, wherein the anchor hitch is recessed into the floatable base.

6. The apparatus of claim 1, wherein the floatable base has a pointed end.

7. The apparatus of claim 1, further comprising a cooler retention rim extending upward from the floatable base adjacent the liquor bottle rack.

8. The apparatus of claim 1, wherein each of the compartments on the liquor bottle rack has a rectangular cross section.

9. The apparatus of claim 1, wherein:

the liquor bottle rack has an inner row of compartments and two outer rows of compartments, each row having at least 4 compartments; and the inner row of compartments has a first height extending above the floatable base and the two outer rows of compartments each have a second height extending above the floatable base, wherein the first height is at least 1.5 times greater than the second height.

10. The apparatus of claim 1, further comprising at least one shading structure detachably disposed on the liquor bottle rack, the at least one shading structure extending upward from the liquor bottle rack.

11. The apparatus of claim 1, further comprising a lighting structure detachably disposed on the liquor bottle rack, the lighting structure including a plurality of light sources, a power supply, and a switch, the switch selectively providing power from the power supply to the plurality of light sources.

12. The apparatus of claim 1, wherein each compartment of the liquor storage rack has a compartment volume, and the apparatus further comprises a storage container positioned adjacent the liquor bottle rack, the storage container having a container volume greater than the compartment volume.

13. The apparatus of claim 1, further comprising an accessory holder positioned beside the liquor bottle rack, the accessory holder including a plurality of accessory compartments.

14. The apparatus of claim 1, wherein the floatable base further comprises one or more internal support ribs.

15. A recreational floating bar apparatus capable of carrying beverages including 750 milliliter liquor bottles and drinking vessels, comprising:

a floatable base;

a liquor bottle rack extending upward from the floatable base, the liquor bottle rack having a row of at least four rectangular compartments, each compartment sized to receive one of the 750 milliliter liquor bottles;

a first set of drinking vessel retainers positioned radially outward from the liquor bottle rack;

one or more guard rails at least partially surrounding the first set of drinking vessel retainers, the one or more guard rails extending from the floatable base above the first set of drinking vessel retainers; and a second set of drinking vessel retainers positioned radially outward from the liquor bottle rack and the first set of drinking vessel retainers.

16. The apparatus of claim 15, further comprising extendable legs connected to the floatable base, the extendable legs movable between a retracted position and an expanded position on the floatable base.

17. The apparatus of claim 15, wherein each of the second set of drinking vessel retainers includes a floor and an intermediate shelf positioned within the drinking vessel retainer, the intermediate shelf extending upward from the floor of the drinking vessel retainer and positioned below an upper opening of the drinking vessel retainer.

18. The apparatus of claim 15, further comprising a secondary float hitch disposed on the floatable base.

19. A recreational floating bar apparatus capable of carrying beverages including 750 milliliter liquor bottles and drinking vessels, comprising:

a floatable base;

a liquor bottle rack extending upward from the floatable base, the liquor bottle rack having an inner row of compartments and two outer rows of compartments, each compartment of the inner and outer rows of compartments sized to receive one of the 750 milliliter liquor bottles, wherein the inner row of compartments extends a first distance above the floatable base and the two outer rows of compartments extend a second distance above the floatable base, and the first distance is at least 1.5 times greater than the second distance;

a first set of drinking vessel retainers positioned radially outward from the liquor bottle rack, each drinking vessel retainer of the first set of drinking vessels retainers having a first diameter; and a second set of drinking vessel retainers positioned radially outward from the liquor bottle rack and the first set of drinking vessel retainers, each drinking vessel retainer of the second set of drinking vessel retainers having a second diameter;

wherein the second diameter is greater than the first diameter.

* * * * *